US006371494B1

(12) United States Patent
Bonaventure et al.

(10) Patent No.: US 6,371,494 B1
(45) Date of Patent: Apr. 16, 2002

(54) SPORTS BOOT WITH VARIABLE RIGIDITY

(75) Inventors: Laurent Bonaventure, Cran Gevrier; Laurent Marechal, Argonay; Gabriel Portaud, Annecy, all of (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/479,879

(22) Filed: Jan. 10, 2000

(30) Foreign Application Priority Data

Dec. 1, 1999 (FR) ..... 99 15439

(51) Int. Cl.[7] ..... A63C 17/00; A43B 23/00; A43B 5/04; A43B 5/16

(52) U.S. Cl. ..... 280/11.19; 280/11.221; 36/115; 36/116; 36/117.1; 36/118.2; 36/118.9; 36/45

(58) Field of Search ..... 280/11.19, 11.221; 36/115, 116, 117.1, 117.2, 117.8, 118.2, 118.9, 119.1, 45, 48, 51

(56) References Cited

U.S. PATENT DOCUMENTS

| | | | | | |
|---|---|---|---|---|---|
| 3,419,974 | A | * | 1/1969 | Lange | 36/118.2 |
| 5,177,884 | A | | 1/1993 | Rullier | |
| 5,357,695 | A | * | 10/1994 | Lu | 36/115 |
| 5,397,141 | A | * | 3/1995 | Hoshizaki et al. | 36/115 |
| 5,437,466 | A | | 8/1995 | Meibock et al. | |
| 5,678,833 | A | * | 10/1997 | Olson et al. | 36/115 |
| 5,839,735 | A | | 11/1998 | Benoit | |
| 5,884,420 | A | | 3/1999 | Donnadieu | |
| 5,887,361 | A | | 3/1999 | Cabanis et al. | |
| 5,913,526 | A | * | 6/1999 | Olson | 36/115 |
| 6,045,144 | A | * | 4/2000 | Wong | 36/115 |
| 6,050,574 | A | * | 4/2000 | Olson et al. | 36/115 |
| 6,148,546 | A | | 11/2000 | Demarchi | |

FOREIGN PATENT DOCUMENTS

| | | | | |
|---|---|---|---|---|
| EP | 381614 | * | 8/1990 | 36/118.9 |
| EP | 0572862 | | 12/1993 | |
| EP | 0818157 | | 1/1998 | |
| FR | 2768310 | | 3/1999 | |
| FR | 2772243 | | 6/1999 | |
| WO | 90/05465 | * | 5/1990 | 36/118.9 |
| WO | WO99/30586 | | 6/1999 | |

* cited by examiner

*Primary Examiner*—Anthony Stashick
(74) *Attorney, Agent, or Firm*—Greenblum & Bernstein, P.L.C.

(57) ABSTRACT

A sports boot, particularly for gliding sports, of the type including a rigid sole, an external upper, and a removal liner, the external upper including a first portion made of a rigid and substantially non-flexible material including at least one heel stiffener; a second portion, attached to the first portion and/or to the sole, made of a substantially rigid and flexible material; a third portion attached to the second portion and made of a flexible material. The second portion includes a collar adapted to at least partially surround the user's ankle, and a vamp. The third portion includes a saddle attached to the vamp, and on which a device for tightening the forefoot is arranged. The third portion can also include two flaps attached to the collar, and on which a tightening device is arranged.

29 Claims, 4 Drawing Sheets

9

2
11
36
8
37
38
1
19
6
10
7
5
3

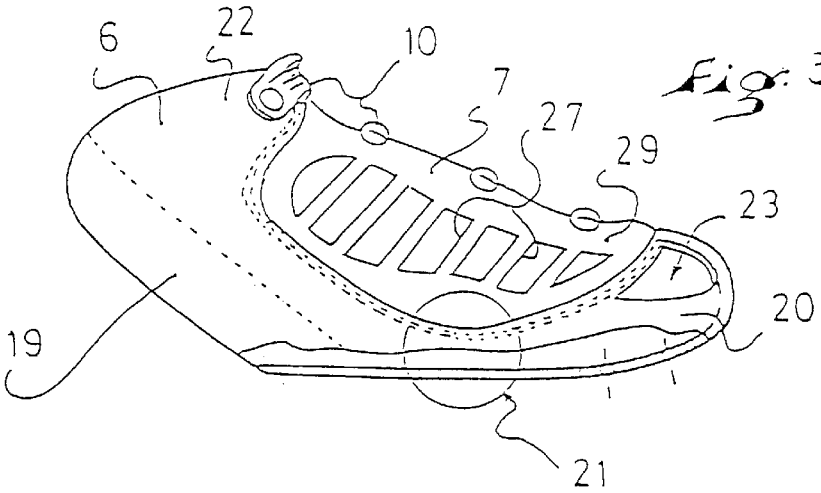
Fig. 3
Fig. 4
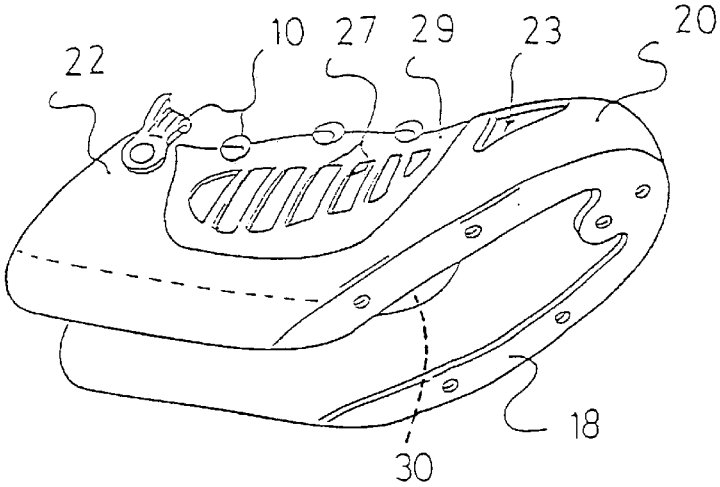
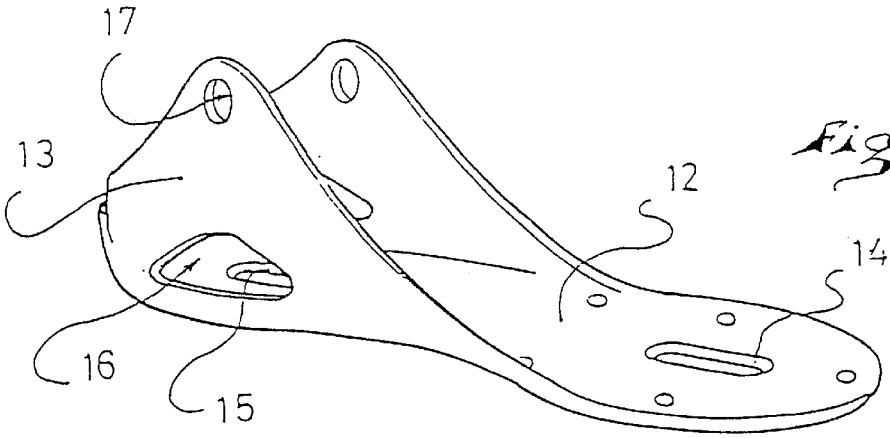
Fig. 2

SPORTS BOOT WITH VARIABLE RIGIDITY

BACKGROUND OF THE INVENTION

1. Field of the Invention

The present invention relates to a sports boot, especially a gliding sports boot, or a boot for any other sport requiring the transmission of special forces, and including, in its manufacture, at least molding one of its elements. Gliding sports especially include alpine skiing, mountain skiing or cross-country skiing. snowboarding, back-country skiing, as well as ice skating and roller skating.

2. Description of Background and Relevant Information

It is widely known to manufacture a sports boot by molding plastic material for all of its components. In general, such boots are constituted of a limited number of elements; only those elements intended to move relative to one another are made distinct from one another. This method, which has been very much used for manufacturing boots for alpine ski and roller skates, among others, is very costly, because it requires molds to be made, and is not very adaptable, because the rigidity of the boot remains identical at every point thereof.

To manufacture a boot whose rigidity is not identical at every point thereof, it was first thought to vary the shell thickness. However, in order to obtain a satisfactory rigidity gradient with this method, it is necessary to use a relatively flexible material and mold it with excessive thickness in the areas where maximum rigidity is sought.

Due to these excessive thicknesses, the boots made by this method are heavy during use. Another solution consists in performing a dual-material molding, but this technique remains expensive and complicated. Moreover, the two materials that are then molded simultaneously must have relatively close chemical and physical properties, which reduces the possible rigidity gradient.

In mountain skiing, or cross-country skiing, the requirement for foot movement, in the conventional technique, and the least force transmission are such that boots are generally more flexible, and that conventional techniques, i.e., assembly by adhesive ;bonding and stitching, are primarily used during their manufacture. However, this is no longer true for the boots adapted for the practice of skating step, for which foot movement of the type carried out in the conventional technique is no longer necessary. Thus, in order for a cross-country ski boot to be efficient, some of its elements, especially the heel stiffener, must be rigid. The problem of incorporating a rigid element within a flexible structure then arises.

Two types of constructions are currently used in the manufacture of boots for roller skates: the rigid construction and the flexible construction. The rigid construction derives from the construction of alpine ski boots; a flexible liner is maintained in a rigid shell.

With such a construction, each renewed line of skates requires a number of new molds to be made, even if the changes are only aesthetic.

The flexible construction derives from the construction of cross-country ski boots.

With such a construction, it is very difficult to envision a complete line of skates, i.e., ranging from models for beginners to models for experts, while retaining the maximum of common elements.

Both of these two constructions render very costly any changes made to a line of skates.

SUMMARY OF THE INVENTION

An object of the present invention is to overcome the aforementioned disadvantages. More particularly, an object of the invention is to provide a sport boot, especially for skiing or skating, whose rigidity is not constant at every point thereof, and whose structure facilitates the changes to be made to the line.

The boot according to the invention includes at least three distinctive portions. Specifically, the boot has a rigid sole, an external upper attached to this sole, and a removable, or irremovable independent liner. The external upper has a first rigid and non-flexible portion. This first portion is attached to the sole or is an integral part thereof; it has at least one heel stiffener. The external upper also has a second portion that is less rigid than that of the first portion and less flexible than a third portion, and is attached to the first portion and/or to the sole. The external upper further has a flexible third portion attached to the second portion.

The arrangement of the three portions of the external upper, with respect to one another, is such that, except the zones that are necessary for their attachment, they are not superimposed, which allows a real rigidity gradient, from the most rigid first portion to the flexible third portion.

Preferably, the second portion has a vamp at the front of the boot, and a collar in the area of the ankle; the vamp can be attached by any permanent or non-permanent attachment members or mechanism, to the first portion and/or to the sole. Preferably, the attachment members used include rivets or screws. In the case where the attachment members are screws, they allow the vamp to be disassembled, then reassembled on the first portion and/or on the sole.

The third portion has one or more portions that are essentially attached to the second portion by any attachment members of mechanism. Preferably, the third portion is attached to the second portion by detachable or non-detachable attachment mechanism(s), such as adhesives or stitching, adapted to the flexible materials.

The difference in rigidity and flexibility between the first portion and the third portion is substantial.

The second portion, while having a rigidity and flexibility comprised between that of the first and third portion, can take a plurality of values of rigidity and flexibility. Therefore, by retaining numerous common elements, one can design a line of boots, including boots having a firm foot retention, boots with flexible retention and all intermediate levels of retention. In particular, the first rigid portion can be kept as common to all models in the line by only replacing the second and third portions, thereby substantially reducing the manufacturing costs of the necessary molds.

The third portion occupies a substantial portion of the surface of the upper located on the top of the foot. The replacement of the first and second portions makes it possible to change the external aspect of the boot. Furthermore, this element can be molded on the flat, i.e., without giving it the shape which it will assume once it has been assembled. This third portion can also be obtained by cutting large sheets of plastic material or fabric.

The means for tightening the boot are arranged on one of the three portions. Preferably, these means have a lace system arranged on the third and/or second portion, allowing to adjust the fit of the boot to the user's foot. They also have a strap system attached directly or indirectly to the collar and ensuring the tightening of the lower part of the user's leg. They can also have a strap system attached to the stiffener or to the vamp and ensuring the retention of the heel at the bottom of the boot.

One of the advantages of the invention consists in optimizing the compromise between the retention of the foot, on the one hand, and its comfort, on the other hand. In the zones where retention is necessary, such as in the heel zone, for example, the external upper is equivalent to a shell-type rigid upper. On the other hand, in the zones where an adjustment of the upper to the user's foot occurs, i.e., on the top of the foot, among others, and where comfort is desirable, one benefits from the advantages of a flexible external upper.

The construction of a sports boot according to the invention therefore offers, at low cost, a wide variety of embodiments, namely, boots having numerous common elements, or using the same molds but having their own designs, and boots whose elements are made in the same molds but have different characteristics in terms of retention and comfort.

In the case of skating, one can thus provide a line including skates for experts having a maximum of flexible elements, as well as skates for beginners in which the more rigid elements prevail, without the costly manufacture of numerous molds.

BRIEF DESCRIPTION OF THE DRAWINGS

The present invention also relates to the characteristics which will become apparent from the description that follows, with reference to the annexed drawings which show, by way of non-limiting examples, three embodiments in the field of in-line roller skates, and in which:

FIG. 2 is a perspective view of the cradle of the skate shown in FIG. 1;

FIGS. 3 and 4 are a side view and a perspective bottom view, respectively, of the vamp and saddle of the skate shown in FIG. 1;

DETAILED DESCRIPTION OF THE INVENTION

Figure 1:
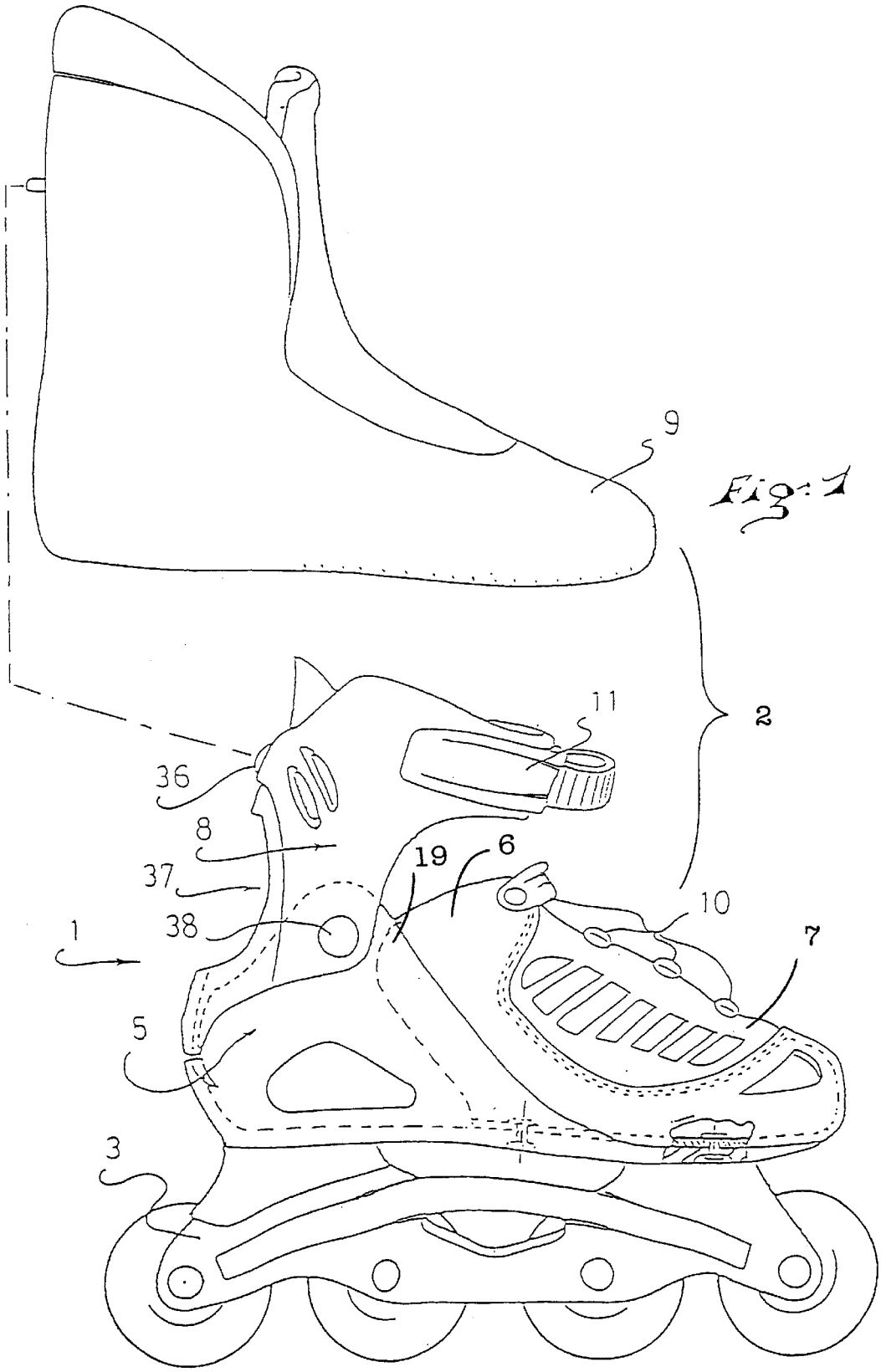
FIG. 1 is an exploded view of a skate equipped with a boot according to a first embodiment of the invention.

FIG. 1 shows an in-line roller skate 1 constituted of a chassis 3 to which a boot 2 is attached. The boot is composed of an independent liner 9 arranged in an external upper which includes a cradle 5, a collar 8 pivotally mounted on the cradle, by means of pivots 38, a vamp 6, and a saddle 7. The collar 8 is provided to surround the lower part of the user's leg.

The liner 9 is maintained in place in the external upper due a screw 36 which connects the rear top portion of the liner 9 to the collar 8. A rear opening 37 is provided in the collar 8 in the area of the two pivots 38 which ensure the fastening of the latter to the cradle 5. In fact, this rear opening 37, in conjunction with the relative flexibility of the collar, constitutes a structure for the elastic return of the latter. This structure is biased by rear pivoting of the collar from an inactive position of equilibrium.

A third point for fastening the collar to the cradle is arranged at the rear of the stiffener, in the lowermost portion of the collar. In this case, the aforementioned elastic return structure is also biased by front pivoting of the collar. A closing mechanism of the collar, constituted of a notched strap and a ratchet lever 11, makes it possible to adjust the collar to the lower part of the user's leg. Any other closing system, with a Velcro® buckle, for example, can be envisioned.

Furthermore, the collar can originate directly from the cradle and be made flexible with respect to the cradle by means of slits and/or appropriate cutting.

FIG. 2 shows the cradle 5 in perspective. The latter includes a sole 12 and a stiffener 13 surrounding the heel. The material used for the cradle 5 is preferably a very rigid and substantially non-flexible plastic material.

Slots 14, 15 are provided in the sole to allow fastening the boot 2 to the chassis 3. An opening 16 on each side of the stiffener 13 gives a slight flexibility to the top portion of the stiffener. Holes 17 are used for fastening the collar to the cradle by means of pivots 38.

Figure 8:
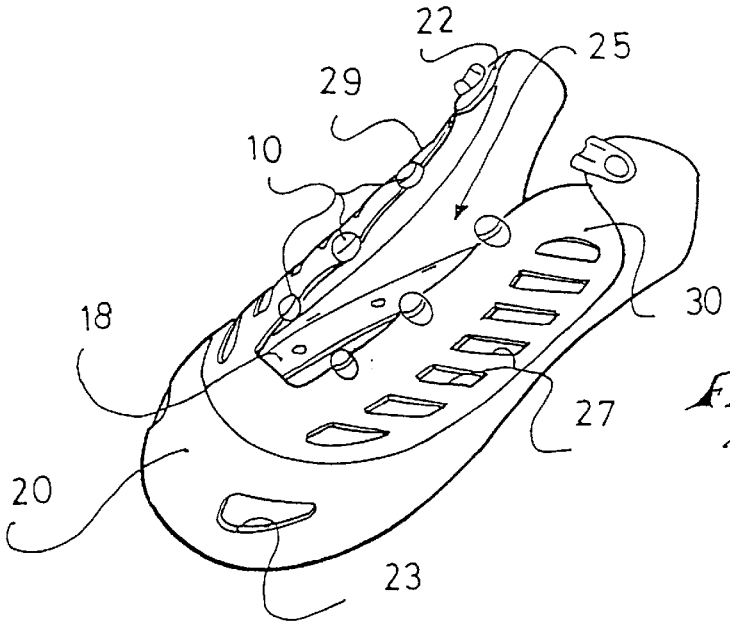
FIG. 8 is a top perspective view of the vamp and saddle of the skate shown in FIG. 1.

FIGS. 3, 4, and 8 show a side view, a perspective bottom view, and a perspective top view, respectively, of the vamp 6 and saddle 7. The vamp 6 is made out of a plastic material that is less rigid than the cradle 5 and especially more flexible than the latter. It is fastened to the cradle 5, in the area of the sole, by bringing a return 18 and the sole into contact, on the one hand, and by bringing the border 19 and the stiffener 13 into contact, on the other hand. In this embodiment, the shape given to the vamp 6 is characterized as follows: a toe-cap 20 covers the end of the foot (toe zone); a very slight vertical elevation in the area of the metatarso-phalangeal flexion zone 21 and two extensions 22 are adapted to ensure the retention at the level of the instep girth. Slits 23 are possibly provided in the toe-cap 20 to allow the ventilation of the skater's foot.

The saddle is made of a very flexible plastic material or textile. It is composed of one or more inlays surrounded by an edge. The edge, not visible in the drawing, corresponds to the portion of the saddle which, for the purpose of fastening it to the vamp 6, is superimposed on the latter. In the embodiment shown, this fastening is done by stitching. A central opening 25 separates the saddle 7 into a lateral saddle 29 and a medial saddle 30. The lateral saddle 29 and the medial saddle 30 are connected to one another at their front end. A lace tightening device having guides 10 attached to the saddle, on both sides of the central opening, makes it possible to adjust the fit of the boot to the user's foot. Cutouts 27 are provided on part or all of the saddle to make the latter more flexible, as well as to improve the ventilation. Fabric can be arranged within these cutouts.

Figure 5:
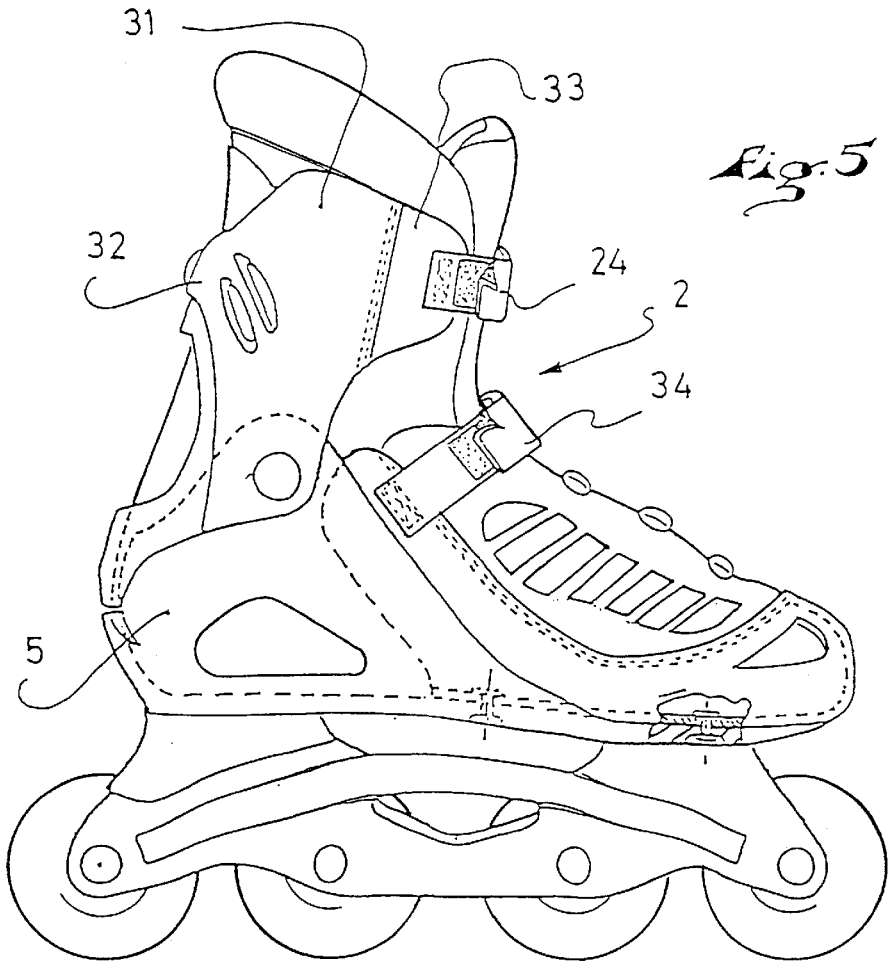
FIG. 5 is a side view of a skate equipped with a boot according to a second embodiment of the invention.

FIG. 5 shows a second embodiment of the invention. According to this embodiment, the collar 8 of the skate 1 is no longer made of a single rigid plastic piece, but of a plurality of pieces of different rigidities. It has two lateral breast flap edges 31 connected to one another by a bridge 32 which forms the rear belt of the lower part of the user's leg. The lateral breast flap edges 31 are attached at their lower ends to the cradle 5. A flap 33 is attached to each of the breast flap edges so as to close the belt of the lower part of the leg toward the front of the skate.

According to the invention, the flaps 33 are made of a material that is less rigid than the material of the lateral breast flap edges 31 and bridge 32, the latter material itself being less rigid than that of the cradle 5. The closure of the collar can be done by any tightening device, such as a notched strap associated with a ratchet hook. However, due to the greater flexibility of the flaps, a more simple tightening device, such as a woven or non-woven flexible strap system 24, and on which Velcro® strips are attached, can be used. To ensure tightening in the area of the instep girth, a strap tightening device 34 is attached on both sides to the two stiffeners 13 of the cradle 5. In this embodiment, the rigidity gradient is obtained both in the area of the vamp and in the area of the ankle tightening.

Figure 6:
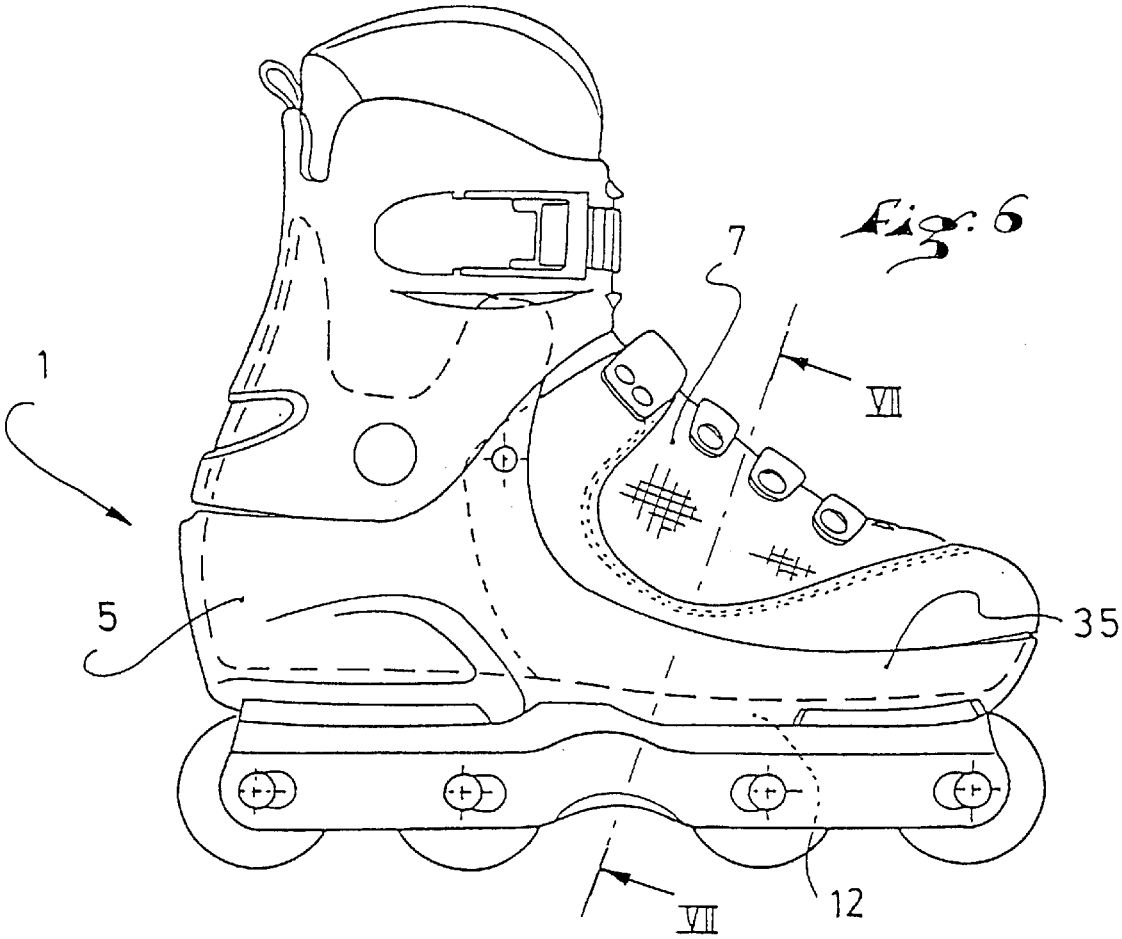
FIGS. 6 and 7 are a side view and a partial cross-section, respectively, of a skate equipped with a boot according to a third embodiment of the invention.

FIG. 6 shows a third embodiment of the invention. The skate 1 which is shown therein is especially adapted for the so-called "aggressive" practice. In this type of practice, a part of the acrobatic maneuvers include gliding phases for the chassis or the shell on hard bodies such as ramps, rails, or concrete surfaces. Conventionally, the boot of this skate is made of a very rigid and wear-resistant shell. Therefore, these skates are uncomfortable and considerably limit the movements of the user. However, performing certain maneuvers requires a certain flexibility of the foot. The cradle 5 shown in FIG. 6 rises high enough to ensure good protection of the ankle. Moreover, it has, in its front portion, a flange 35 which rises vertically from the sole 12. The vamp is made of a softer material than the cradle. It is sufficiently thick to provide good resistance to wear and tear. The saddle 7 is made of a synthetic fabric of the mesh type, guaranteeing excellent durability and promoting breatheability.

Figure 7:
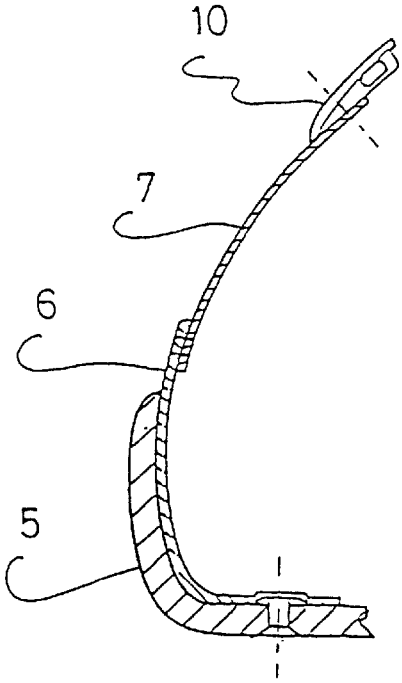

FIG. 7 shows a partial cross-section of the boot of the skate shown in FIG. 6. The vamp 6 is fastened to the cradle by rivets in the area of the sole and in the area of the heel stiffener. The saddle 7 is attached to the vamp 6 by stitching.

The present invention is not limited to the preceding examples of embodiments that are disclosed herein for guidance only.

The instant application is based upon French Application No. 99 15439, filed on Dec. 1, 1999, the disclosure of which is hereby incorporated by reference thereto in its entirety, and the priority of which is hereby claimed under 35 USC 119.

What is claimed is:

1. A sport boot comprising:

a rigid sole, an external upper, and an independent internal liner;

the external upper comprising:

a rigid portion comprising a heel stiffener;

a flexible saddle occupying a substantial portion of the external upper extending above a foot of a wearer;

a vamp connecting the flexible saddle to the rigid portion, the vamp being more flexible than the rigid portion and more rigid than the saddle.

2. A boot according to claim 1, wherein the saddle is made by having been molded flat or by cutting a sheet of plastic material or fabric.

3. A boot according to claim 1, wherein the vamp comprises a toe cap and two extensions adapted to ensure retention in an instep girth area.

4. A boot according to claim 1, wherein a device for tightening a forefoot is arranged on the saddle.

5. A boot according to claim 1, wherein the saddle includes a lateral saddle and a medial saddle connected to one another at their end that is the closest to the front of the boot, and defining between them a central opening allowing introducing a foot of a wearer into the boot.

6. A boot according to claim 3, wherein the saddle is made of a flexible plastic material, and wherein cutouts are provided thereon.

7. A boot according to claim 1, wherein the vamp comprises a toe cap and two extensions adapted to ensure retention in an instep girth area, wherein a device for tightening a forefoot is arranged on the saddle, and wherein at least one guide for the tightening device is arranged on each of the two extensions.

8. A boot according to claim 1, wherein the stiffener and the sole are part of an integral single piece called cradle.

9. A boot according to claim 2, wherein the vamp is attached directly to the rigid sole on a front portion of the vamp, and to the heel stiffener on a rear portion of the vamp.

10. A boot according to claim 9, wherein the rigid sole and the heel stiffener define a sole/stiffener subassembly, and wherein the vamp is attached to the sole/stiffener subassembly by means of rivets.

11. A boot according to claim 3, wherein the saddle is stitched on the vamp.

12. A boot according to claim 3, wherein the saddle is made of a synthetic material.

13. A boot according to claim 2, wherein slits are provided extending through the vamp.

14. A boot according to claim 1, wherein slots are provided in the stiffener.

15. A boot according to claim 2, wherein the external upper further comprises a collar adapted to at least partially surround an ankle of a wearer, and the collar is fastened to the stiffener with at least two fastening elements located on opposite sides of the heel stiffener in a malleoli area of a wearer of the boot.

16. A boot according to claim 15, wherein the fastening elements allow pivoting of the collar relative to the heel stiffener.

17. A boot according to claim 15, wherein a third fastening element is located at a rear of the heel stiffener.

18. A boot according to claim 2, wherein the external upper further comprises a collar adapted to at least partially surround an ankle of a wearer, and wherein a rear opening is provided in the collar.

19. A boot according to claim 1, wherein the rigid portion of the external upper includes a flange extending upwardly from the rigid sole in a front portion of the rigid sole.

20. A boot according to claim 1, wherein the rigid portion, the saddle, and the vamp are not superimposed, except in zones that are necessary for their attachment to one another.

21. A roller skate including a chassis equipped with wheels and to which a boot is attached according to claim 1.

22. A boot according to claim 1, wherein the independent internal liner includes a removable connection for rendering the internal liner removable from the boot.

23. A boot according to claim 22, wherein the removable connection comprises a screw.

24. A sport boot, including a boot for a gliding sport, said boot comprising:

an external upper and an independent internal liner positioned within said external upper, said external upper comprising at least first, second, and third portions;

said first portion being rigid and substantially non-flexible, said first portion including a sole and at least one heel stiffener extending upwardly from said sole, said second portion comprising a vamp, and said third portion comprising a saddle;

said vamp being attached to said first portion, said vamp being more rigid than said heel stiffener and more flexible than said saddle;

said saddle being flexible and being connected to and extending transversely from at least parts of said vamp, said saddle extending over a forefoot of a wearer;

said external upper further comprising a device for tightening the boot on a forefoot of the wearer.

25. A sport boot according to claim 24, wherein said third portion including through holes for ventilating the boot during use of the boot.

26. A sport boot according to claim 24, wherein said external upper further comprises a collar adapted to at least partially surround an ankle of a wearer.

27. A sport boot according to claim 24, wherein said saddle includes a central opening defining a lateral saddle and a medial saddle, and wherein said device for tightening the forefoot comprises a lacing and respective pluralities of lacing guides affixed on said lateral saddle and said medial saddle.

28. A sport boot according to claim 27, wherein said device for tightening the forefoot further comprises a rearmost lacing guide on a medial side of said vamp and a rearmost lacing guide on a lateral side of said vamp.

29. A sport boot comprising:

a rigid sole, an external upper, and an independent internal liner;

said external upper comprising:

a rigid portion comprising a heel stiffener, said heel stiffener having transversely opposed sides extending upwardly along opposite sides of a heel of a wearer;

a vamp connected to and extending upwardly from a forward part of said rigid portion, said vamp having transversely opposed sides extending forwardly from said transversely opposed sides of said heel stiffener;

a saddle extending transversely from said transversely opposed sides of said vamp to be positioned above a foot of a wearer;

said vamp being more flexible than said heel stiffener and more rigid than said saddle.

* * * * *